US009597853B2

(12) United States Patent
Haessig

(10) Patent No.: US 9,597,853 B2
(45) Date of Patent: Mar. 21, 2017

(54) METHOD AND DEVICE FOR PRODUCING CORRUGATED CARDBOARD

(71) Applicants: PROGROUP AG, Landau (DE); Christophe Haessig, Hunspach (FR)

(72) Inventor: Christophe Haessig, Hunspach (FR)

(73) Assignee: PROGROUP AG, Landau (DE)

( * ) Notice: Subject to any disclaimer, the term of this patent is extended or adjusted under 35 U.S.C. 154(b) by 2 days.

(21) Appl. No.: 14/412,290

(22) PCT Filed: Jul. 5, 2013

(86) PCT No.: PCT/EP2013/001987
§ 371 (c)(1),
(2) Date: Dec. 31, 2014

(87) PCT Pub. No.: WO2014/005719
PCT Pub. Date: Jan. 9, 2014

(65) Prior Publication Data

US 2015/0174851 A1 Jun. 25, 2015

(30) Foreign Application Priority Data

Jul. 5, 2012 (EP) ..... 12004994

(51) Int. Cl.
*B31F 1/28* (2006.01)
*B31F 1/26* (2006.01)
(Continued)

(52) U.S. Cl.
CPC ..... *B31F 1/26* (2013.01); *B31F 1/242* (2013.01); *B31F 1/285* (2013.01); *B31F 1/2813* (2013.01);
(Continued)

(58) Field of Classification Search
None
See application file for complete search history.

(56) References Cited

U.S. PATENT DOCUMENTS 3,513,054 A 5/1970 Rene
5,659,976 A * 8/1997 Klockenkemper ... B31F 1/2813 156/64
(Continued)

FOREIGN PATENT DOCUMENTS

DE 1561510 10/1970
DE 2302449 8/1974
(Continued)

OTHER PUBLICATIONS

International Preliminary Report on Patentability mailed on Jan. 6, 2015 for International Application No. PCT/EP2013/001987, 8 pages.

*Primary Examiner* — Barbara J Musser
(74) *Attorney, Agent, or Firm* — Kilpatrick Townsend & Stockton LLP

(57) ABSTRACT

The invention relates to an apparatus for producing corrugated cardboard products. Said apparatus comprises a first one-sided machine and a second one-sided machine which are configured in each case for producing a single flute corrugated cardboard web. Furthermore, the apparatus has a combining means which is configured for connecting the single flute corrugated cardboard webs. Here, the combining means is provided with a convergence region which is configured for mutual adaptation of the single flute corrugated cardboard webs. Furthermore, the invention relates to a method for producing corrugated cardboard products, in which method a first single flute corrugated cardboard web is connected to a second single flute corrugated cardboard web. During connection, a first single flute corrugated cardboard web and a second single flute corrugated cardboard web run through a convergence region.

25 Claims, 5 Drawing Sheets

(51) Int. Cl.
*B31F 1/24* (2006.01)
*B31F 1/36* (2006.01)

(52) U.S. Cl.
CPC ..... *B31F 1/2836* (2013.01); *B31F 1/2872* (2013.01); *B31F 1/2877* (2013.01); *B31F 1/36* (2013.01); *Y10T 156/1025* (2015.01)

(56) References Cited

U.S. PATENT DOCUMENTS 5,693,167 A * 12/1997 Cahill ..... B31F 1/2813 156/205
5,916,409 A 6/1999 Mosburger

FOREIGN PATENT DOCUMENTS

DE 19506779 8/1996
FR 1212042 3/1960

* cited by examiner

METHOD AND DEVICE FOR PRODUCING CORRUGATED CARDBOARD

PRIORITY CLAIM

This application is a national stage application of PCT/EP2013/001987, filed Jul. 5, 2013, which claims priority to European Patent Application No. 12004994.5, filed on Jul. 5, 2012, the entireties of which are incorporated herein by reference.

TECHNICAL FIELD

The invention relates to an apparatus and a method for producing corrugated cardboard products which serve, for example, as packaging material. Corrugated cardboard products are produced from individual paper webs, a corrugated cardboard product comprising smooth and corrugated paper layers which are connected to one another. Corrugated cardboard products are produced in a continuous method.

PRIOR ART

DE 1 561 510 has disclosed a method for the continuous production of rigid corrugated cardboard, in which method two webs of corrugated cardboard with oblique corrugations are adhesively bonded on one another. The webs with oblique corrugations are produced by in each case one cardboard web being guided between two coupled corrugation cylinders, the corrugation cylinders being manufactured with helical corrugations. A cardboard web which is guided through the coupled corrugation cylinders is guided onto a smooth web at an angle β with regard to the running direction of the corrugated paper machine, which angle β lies in a horizontal plane, and is adhesively bonded to said smooth web. A combined web is produced as a result. Two combined webs are subsequently connected to one another in such a way that their corrugated sides are adhesively bonded to one another without an intermediate layer. It is a disadvantage of the method according to DE 1 561 510 that the apparatus which is required for this purpose is designed merely for corrugated paper without an intermediate layer between the combined webs. Other types of corrugated paper, in particular those with an intermediate layer, can be produced only after complicated changeover of the apparatus which is used for this purpose. Furthermore, apparatuses of this type have a considerable width and take up a large amount of space.

SUMMARY OF THE INVENTION

The invention is based on the object of providing an option for producing corrugated cardboard products in a material-saving and inexpensive way. Furthermore, the invention is based on the object of improving the achievable quality of the produced corrugated cardboard products. Here, a machine construction is aimed for which is space-saving and at the same time ensures a simple and rapid changeover capability. A simple and rapid changeover capability permits a changeover to be made between different types of corrugated cardboard products with minimum down times of the machine.

The apparatus according to the invention for producing corrugated cardboard products comprises a first one-sided machine and a second one-sided machine which are configured in each case for producing a single flute corrugated cardboard web. Furthermore, the apparatus is provided with a combining means which is configured for connecting the single flute corrugated cardboard webs to one another. The combining means has a convergence region, in which the corrugation profile of the first and second single flute corrugated cardboard web are adapted mutually. The mutual adaptation takes place via combining of the single flute corrugated cardboard webs, the head and foot points of the single flute corrugated cardboard webs being in each case in engagement with one another. Corrugated webs of the single flute corrugated cardboard webs form in each case substantially identical profiles by way of the two single flute corrugated cardboard webs being pressed onto one another. The mutual adaptation of the corrugation profile permits single flute corrugated cardboard webs to be produced in a simple and reliable way, the corrugation profiles of which corrugated cardboard webs differ from one another only to a minimum. The small deviation makes it possible to connect the single flute corrugated cardboard webs exactly to one another geometrically when said single flute corrugated cardboard webs are combined. Precisely positioned contact points between head points of the single flute corrugated cardboard webs can be produced in this way. Precisely positioned contact points between corrugated webs allow material-saving corrugated cardboard architectures to be produced without an additional intermediate layer between the corrugated webs. Furthermore, high achievable geometric exactness of the corrugated webs and their contact points ensures the use of corrugated cardboard architectures which are precisely pre-calculated in terms of rigidity and strength and completely utilize the material properties of the layers which are used. As a result, high efficiency is achieved in the sense of lightweight construction. Furthermore, the method according to the invention compensates for deviations in the parallelism of single flute corrugated cardboard webs. The apparatus according to the invention is configured in such a way that the above-described advantages can be achieved in a continuous production process.

Furthermore, the apparatus according to the invention can have a first one-sided machine which is equipped with a first corrugating roll which has a corrugation. Here, the corrugation runs parallel to the rotational axis of the first corrugating roll. Furthermore, the first one-sided machine has a counterpart to the first corrugating roll. Furthermore, the apparatus can advantageously be equipped with a second one-sided machine which has a second corrugating roll with a second counterpart. Here, the second corrugating roll has a corrugation which runs parallel to the rotational axis of the second corrugating roll. A corrugation of a corrugating roll which is oriented parallel to the rotational axis allows a paper web to be provided with a corrugation profile in a nip between a corrugating roll and a counterpart to the corrugating roll. Here, the corrugation profile is likewise oriented parallel to the rotational axis of the corrugating roll. The nip between a corrugating roll which is corrugated in parallel and its counterpart is insensitive to distortions of the paper web and reliably produces a substantially homogeneous corrugation profile when a supplied paper web runs through.

In the apparatus according to the invention, the convergence region can advantageously be configured between a first and a second diverting roller. Here, the first diverting roller defines the start of the convergence region. An outlet can be configured on the second diverting roller, at which outlet separation of the first from the second single flute corrugated paper web takes place. The outlet in the region of the second diverting roller defines the end of the convergence region. The use of diverting rollers allows the formation of a convergence region in a simple way, in which convergence region the first and second single flute corrugated cardboard web are transported with taut guidance. Taut guidance of the combined first and second single flute corrugated cardboard web makes a conveying path available, in which the corrugation profiles of the corrugated webs can be adapted to one another. As a result, the accuracy of the mutual adaptation of the corrugation profiles is improved. This allows higher geometrical exactness and therefore overall quality of the corrugated cardboard products to be produced.

In a further advantageous way, the apparatus according to the invention can be equipped with at least one water vapor supply in the region of the combining means. The water vapor supply serves to moisten at least one top web of a single flute corrugated cardboard web. Water vapor supplies can be arranged in a simple way upstream of an entry into the convergence region and, by way of moistening, allow an increase in the deformability of the top web or corrugated web of a single flute corrugated cardboard web. Here, an increased deformability comprises an elevated stretchability and elasticity with respect to the state, in which the single flute corrugated cardboard web reaches the combining means. An increased deformability of at least one single flute corrugated cardboard web improves the exactness of the geometric adaptation of the corrugation profiles in the convergence region. The exactness of the geometric accuracy which can be achieved of the corrugated webs improves the quality which can be achieved of the corrugated cardboard products to be produced. Furthermore, the single flute corrugated cardboard webs are held in the convergence region in a mechanical stressed state by means of at least one bridge brake. The stressed state increases the action of the mutual geometric adaptation of the single flute corrugated cardboard webs. Here, the corrugation profiles are matched and oriented over the entire web width. Deviations in the parallelism or homogeneity of the corrugation lengths of the corrugation profiles which are caused by inaccuracies of roll geometries, roll orientations, paper web windings or web courses are compensated for.

Furthermore, the apparatus according to the invention can be provided with at least one heating plate which is arranged for heating at least one single flute corrugated cardboard web. Heating of a single flute corrugated cardboard web reduces its deformability and allows the mutual adaptation of the corrugation profiles which is achieved in the convergence region to be made permanent. Furthermore, shrinkage of the single flute corrugated cardboard webs is produced as a consequence of heating. A reduction in the deformability and shrinkage ensures that the mutual adaptation which is achieved in the convergence region is maintained until the single flute corrugated cardboard webs are joined together. This ensures a high quality of the corrugated cardboard products to be produced.

In an alternative embodiment of the apparatus according to the invention, the combining means is equipped with a convergence region which comprises a heating cylinder. Heating cylinders can be temperature-controlled with high accuracy, with the result that the intensity of a drying operation of the single flute corrugated cardboard webs can be set precisely. Drying of the single flute corrugated cardboard webs reduces their deformability and makes the mutual adaptation of the corrugation profiles which is achieved in the convergence region permanent. Furthermore, a heating cylinder with a great diameter can be used, with the result that the single flute corrugated cardboard webs are guided along on a circumferential face of the heating cylinder with low deformation and therefore under low mechanical loads. As a result, distortions or damage of the single flute corrugated cardboard webs are avoided, with the result that a high geometric exactness of the corrugation profiles is maintained.

In a further advantageous way, the heating cylinder can be provided with a roller support, in which a first and a second diverting roller are received rotatably. Here, the roller support can be pivoted about the center point of the heating cylinder. Furthermore, the first and the second diverting roller can form a nip in each case with the circumferential face of the heating cylinder. A nip of this type serves for guiding through the first and second single flute corrugated cardboard web. The pivotable roller support allows the region, in which the first and second single flute corrugated cardboard web are in contact with the heating cylinder, to be changed by way of deflection by a pivoting angle. As a result, the convergence region is extended, in which the mutual adaptation of the corrugation profiles of the first and second single flute corrugated cardboard web takes place. This represents a manipulated variable which can be set exactly and via which the effectiveness of the drying of the single flute corrugated cardboard webs can be set. The longer the convergence region, the higher the drying effect of the heating cylinder. The higher that the production speed is set, the lower the drying action of the heating cylinder. An extension of the convergence region makes it possible, for example, to increase the production speed with a constant drying action. Furthermore, an increase in the temperature of the heating cylinder allows an increased production speed. A temperature increase is associated with an increased energy consumption. The setting of the length of the convergence region allows the parameters of production speed and energy consumption to be selected freely in a broad value range. This widens the spectrum of use of the apparatus according to the invention.

Furthermore, the apparatus according to the invention can have a combining means, in which a divergence region is configured. Separation of the single flute corrugated cardboard webs by means of at least one deflection roll takes place in the divergence region. The use of a deflection roll provides a simple option for separating the two single flute corrugated cardboard webs from one another and, as a result, for feeding them to separate further processing. In a further advantageous way, the at least one deflection roll can be configured such that it can be moved perpendicularly with respect to a running path of one of the single flute corrugated cardboard webs. A deflection roll which can be moved perpendicularly with respect to a running path of a single flute corrugated cardboard web provides an option for controlling the separating operation. As a result, the angle is determined, at which the two single flute corrugated cardboard webs are separated from one another. Moreover, a deflection roll which can be moved perpendicularly with respect to a running path allows said running path to be extended or to be shortened. The movement of the deflection roll can be controlled exactly in a simple way, with the result that a running path difference is produced between the single flute corrugated cardboard webs. The running path difference causes the single flute corrugated cardboard webs to have an offset with respect to one another at the end of the divergence region along their running paths. Here, the offset of the single flute corrugated cardboard webs can be set with an accuracy in the range of millimeters. Accurate setting of the offset allows single flute corrugated cardboard webs with different corrugation profiles to be processed. This increases a wide variety of products which can be produced by means of the apparatus according to the invention.

In a further advantageous embodiment of the apparatus according to the invention, the length of a first running path of the first single flute corrugated cardboard web differs from the length of a second running path of the second single flute corrugated cardboard web by half a corrugation length of a profile of the first single flute corrugated cardboard web. Running paths of different lengths of the first and second single flute corrugated cardboard web allow the two single flute corrugated cardboard webs to run geometrically exactly onto one another at the end of the divergence region. An offset by half a corrugation length of the corrugation profile ensures that the single flute corrugated cardboard webs which were previously in engagement run onto one another in such a way that head points of the corrugated webs of the corrugated cardboard profiles are in mutual contact during the connection to produce a corrugated cardboard product. Here, two head points of a corrugated web form one contact point. This ensures that single flute corrugated cardboard webs are connected to one another precisely in the region of the head points. This allows corrugated cardboard architectures to be realized which completely utilize the material properties of the layers which are used.

Furthermore, the apparatus according to the invention can be configured with a one-sided machine which has a turning device. The turning device is configured to reverse the orientation of the first or second single flute corrugated cardboard web. The reversal of the orientation determines whether the top web or the corrugated web of a single flute corrugated cardboard web faces the respectively other single flute corrugated cardboard web. Turning devices provide simple and robust technical options for adapting the apparatus according to the invention to the requirements of different corrugated cardboard architectures. The use spectrum and the cost efficiency of the apparatus according to the invention are increased as a result.

Furthermore, the invention relates to a method for producing corrugated cardboard products, which method comprises the following steps: in a first step, a first single flute corrugated cardboard web is produced from a first top web and a paper web by means of a first one-sided machine. In a second step, a second single flute corrugated cardboard web is produced from a second top web and a paper web by means of a second one-sided machine. In a third step, transporting of the first and second single flute corrugated cardboard web takes place into a combining means. In a fourth step, the first and second single flute corrugated cardboard web are connected to produce a corrugated cardboard product. Here, in the fourth step, corrugation profiles of the first and the second single flute corrugated cardboard web are adapted to one another in a convergence region in a combining means. An adaptation of corrugation profiles provides an option for improving the manufacturing accuracy which can be achieved of the corrugated cardboard product to be produced. Here, the homogeneous corrugation profiles are applied over the entire web width. Deviations in the parallelism or homogeneity of the corrugation lengths of the corrugation profiles which are caused by inaccuracies of roll geometries, roll orientations, paper web windings or web courses are compensated for. In detail, this ensures that regions of corrugation profiles which lie opposite one another are geometrically identical and allow a homogeneous corrugated cardboard architecture. Homogeneous and precise corrugated cardboard architectures make it possible to produce efficient corrugated cardboard architectures in a simple and material-saving way in the sense of lightweight construction.

In the method according to the invention, in a further advantageous way, at least one of the single flute corrugated cardboard webs can be moistened by means of at least one water vapor supply in the fourth step before entry into the convergence region. Moistening of a single flute corrugated cardboard web increases its deformability and ensures complete geometric adaptation of the corrugation profiles of the single flute corrugated cardboard webs. Here, the deformability comprises stretchability and elasticity of the single flute corrugated cardboard webs. The overall strength which can be achieved in the corrugated cardboard product to be produced is increased overall.

Furthermore, in the method according to the invention, the first and second single flute corrugated cardboard web can be combined in the convergence region in such a way that head points of the corrugation profile of the first single flute corrugated cardboard web come into contact with foot points of the corrugation profile of the second single flute corrugated cardboard web. As a result, mutual engagement of the first and second single flute corrugated cardboard web is produced which ensures precise adaptation of the corrugation profile of the single flute corrugated cardboard webs. As a result, the mutual adaptation of the corrugation profiles takes place with minimum overall deformation. Moreover, a method step of this type ensures that the mutual adaptation of the corrugation profiles takes place completely. This improves the accuracy which can be achieved of the corrugated cardboard products to be produced.

In a further advantageous way, in the method according to the invention in the convergence region, the first and/or second single flute corrugated cardboard web can be dried in the convergence region by way of at least one heating plate. Drying of the single flute corrugated cardboard web reduces its deformability, causes shrinkage of the single flute corrugated cardboard webs and makes the geometric adaptation of the corrugation profiles permanent. As a result, further deformations or distortions in the further production process are prevented, with the result that the geometric exactness of the corrugated cardboard architecture which is aimed for is increased. Moreover, it is possible to configure a heating plate over the entire length of the convergence region, with the result that continuous material-protecting drying can take place. Protective drying prevents moisture-induced distortion of the single flute corrugated cardboard web. As a result, the geometric exactness which can be achieved in the corrugated cardboard product to be produced is likewise increased.

In a further advantageous embodiment of the method according to the invention, the first and second single flute corrugated cardboard web are conveyed at an outlet of a second diverting roller into a divergence region. Here, the first and the second single flute corrugated cardboard web are separated from one another by means of at least one deflection roll. Separation of the two single flute corrugated cardboard webs makes it possible to feed them in each case to separate further processing. Here, the use of a deflection roll represents a simple and reliable means, in order to control the separating process. Furthermore, in the method according to the invention, the first corrugated cardboard web can cover a first running path in the divergence region and the second single flute corrugated cardboard web can cover a second running path. Furthermore, the length of the running paths can be set by way of the at least one deflection roll, it being possible for the at least one deflection roll to be displaced perpendicularly with respect to one of the running paths. A displaceable deflection roll makes it possible to determine the angle, at which the two single flute corrugated cardboard webs are separated from one another. Furthermore, the length of the running path can be set exactly in a simple way by way of a deflection roll which can be displaced perpendicularly with respect to a running path. As a result, a running path difference between the first and second running path can be produced in a targeted manner with an accuracy in the range of millimeters.

This ensures exact processing of the single flute corrugated cardboard webs to produce a corrugated cardboard product.

Furthermore, in the method according to the invention, the length of the first running path can differ from the length of the second running path by half a corrugation length of the corrugation profile of the first or second single flute corrugated cardboard web. A running path difference of half a corrugation length of the corrugation profile of the first or second single flute corrugated cardboard web allows the first and second single flute corrugated cardboard web to be guided onto one another at the end of the divergence region in such a way that in each case head points of the corrugation profiles of the single flute corrugated cardboard web form a common contact point. This allows corrugated cardboard profiles to be realized, in which a middle top layer which serves as a fastening plane for the corrugation profiles can be dispensed with. A running path difference in the divergence region can be produced in a simple way with high precision and therefore provides an economical and robust solution for orienting single flute corrugated cardboard webs.

Furthermore, in the method according to the invention, the first and second single flute corrugated cardboard web can be guided toward one another by means of at least one orienting roller at the end of the divergence region. This provides an inexpensive and low-maintenance solution for guiding single flute corrugated cardboard webs onto one another in a precise way. In an alternative embodiment of the method according to the invention, in the fourth step, the first and second single flute corrugated cardboard web can be guided in the convergence region into nips between a heating cylinder and in each case a first and a second diverting roller. Here, the first and second diverting roller are mounted rotatably on a roller support which can be pivoted about the center point of the heating cylinder. Here, the convergence region corresponds to a section on the circumferential face of the heating cylinder, in which section the single flute corrugated cardboard webs bear against the heating cylinder. A heating cylinder can be produced with a great diameter, with the result that the diversion of the single flute corrugated cardboard webs can take place with low mechanical loads. Furthermore, a heating cylinder can be temperature-controlled exactly, with the result that a drying action of the heating cylinder can be set precisely.

Moreover, in the method according to the invention, the length of the convergence region can be increased by way of the deflection of the roller support by a pivoting angle. The convergence region begins in the region of the first diverting roller, where the single flute corrugated cardboard webs, in engagement with one another, come into contact with the heating cylinder. The convergence region ends where the first and second single flute corrugated cardboard web are separated from one another. The head points of the second single flute corrugated cardboard web are positioned opposite the foot points of the first single flute corrugated cardboard web directly downstream of the heating cylinder, where the separating operation of the single flute corrugated cardboard webs begins. A deflection of the roller support by a pivoting angle increases the length of the convergence region substantially by a section at the circumference of the heating cylinder, which is enclosed by the pivoting angle. The size of the pivoting angle can be set precisely in a simple way. This allows the length of the convergence region to be adapted continuously during the production process and to counteract fluctuating parameters in the production process as a result. As a result, the quality which can be achieved of the corrugated cardboard products to be produced is kept at a continuously high quality level.

Furthermore, in the method according to the invention, at least one of the single flute corrugated cardboard webs can be coated with adhesive by means of at least one glue application roll in the region of the combining means. Coating with adhesive ensures in a simple and inexpensive way an option, by means of which the single flute corrugated cardboard webs can be connected to one another structurally.

Furthermore, in the method according to the invention, the orientation of at least one single flute corrugated cardboard web can be reversed by way of a turning device before the first and second single flute corrugated cardboard web are transported into a combining means. The turning of a single flute corrugated cardboard web allows the method according to the invention to be adapted to the requirements of different corrugated cardboard architectures. This ensures high variability and cost efficiency of the method according to the invention.

BRIEF DESCRIPTION OF THE DRAWINGS

In the following text, the invention will be described in greater detail using the drawing, in which.

DESIGN VARIANTS

Figure 1:
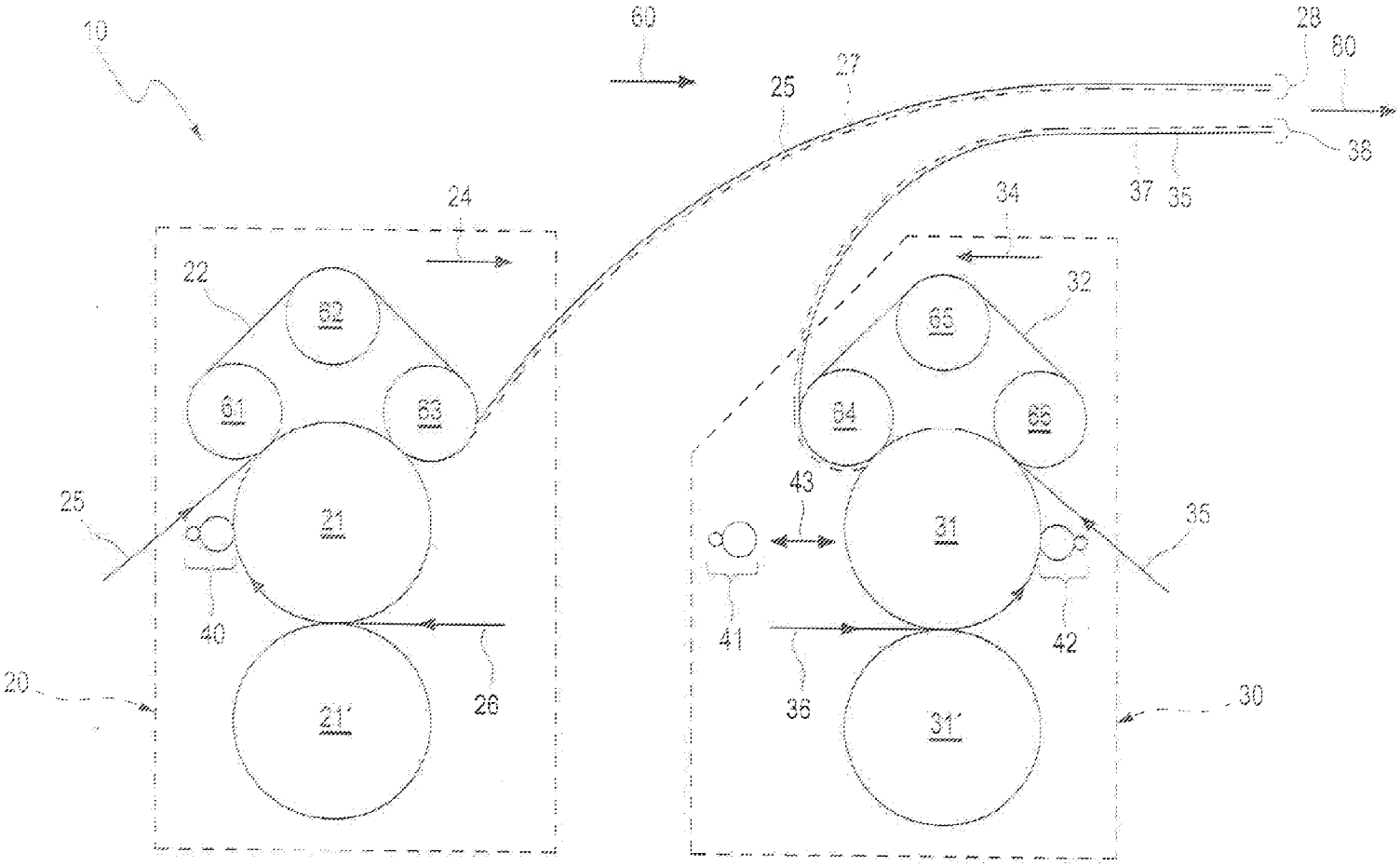
FIG. 1 shows a first arrangement of a first one-sided machine and a second one-sided machine, the single flute corrugated cardboard webs running in opposite directions.

FIG. 1 diagrammatically shows a construction of the apparatus 10 according to the invention which comprises a first one-sided machine 20 and a second one-sided machine 30. Here, the apparatus 10 according to the invention is in a first configuration.

The two one-sided machines 20, 30 comprise in each case one counterpart 21', 31' which is in contact in each case with a corrugating roll 21, 31. The counterparts 2', 31' and the corrugating rolls 21, 31 in each case form a nip, into which a first and second paper web 26, 36 is drawn in. A corrugation profile is embossed onto the first and second paper web 26, 36 by way of the corrugating roll 21, 31. The corrugating rolls 21, 31 have a parallel corrugation on their circumferential face, with the result that the corrugation profile is likewise oriented in parallel. Furthermore, in each case the first and second one-sided machine 20, 30 has a pressing belt 22, 32 which is in contact with the corrugating roll 21, 31. A first pressing belt 22 is guided tautly by way of belt guiding rollers 61, 62, 63 and forms a nip with the circumferential face of the first corrugating roll 21. The first paper web 26 which is to be provided with a corrugation profile and the first top web 25 are drawn into the nip between the first pressing belt 22 and the first corrugating roll 21. Here, the first top web 25 and the first paper web 26 which is provided with a corrugation profile are connected to produce a single flute corrugated cardboard web 28. The nip which is formed between the first pressing belt 22 and the first corrugating roll 21 allows a high pressing impulse to be applied to the webs 25, 26, a low pressing force being produced. Furthermore, the first one-sided machine is equipped with a first glue application unit 40. The first glue application unit 40 provides adhesive which produces an adhesive connection between the first top web 25 and the paper web 26 which is provided with a corrugation profile.

In the same way as in the first one-sided machine 20, a second paper web 36 is drawn in the second one-sided machine 30 into a nip between the counterpart 31' and the second corrugating roll 31, the second paper web 36 being provided with a corrugation profile. On its circumferential face, the second corrugating roll 31 has a parallel corrugation, with the result that the corrugation profile is likewise oriented in parallel. Furthermore, a second pressing belt 32 which is guided tautly by belt guiding rollers 64, 65, 66 forms a nip with the second corrugating roll 31. Furthermore, a second top web 35 is drawn into the nip between the second pressing belt 32 and the second corrugating roll 31. The paper webs 35, 36 are connected in the nip by way of a high pressing impulse with a low pressing force and form a second single flute corrugated cardboard web 38 at the exit from the second one-sided machine 30. The second one-sided machine 30 is provided with a second glue application unit 41 which can be moved in a movement direction 43. If the second glue application unit 42 is moved along the movement direction 43, it is not in contact with the second corrugating roll 31. Furthermore, the second one-sided machine 30 has a third glue application unit 42 which is in contact with the second corrugating roll 31. The third glue application unit 42 provides adhesive which produces an adhesive connection between the second top web 35 and the second paper web 36 which is provided with a corrugation profile.

The first one-sided machine 20 has a web conveying direction 24, in which the first single flute corrugated cardboard web 28 exits from the first one-sided machine 20. The second one-sided machine 30 has a web conveying direction 34, in which the second single flute corrugated cardboard web 38 exits from the second one-sided machine 30. Here, the web conveying directions 24, 34 of the first and second one-sided machine 20, 30 run in opposite directions to one another.

Downstream of the one-sided machines 20, 30, the first and second single flute corrugated cardboard web 28, 38 run in an identical running direction 60 of the apparatus 10 according to the invention. Here, the first and second single flute corrugated cardboard web 28, 38 are oriented in such a way that their corrugated webs 27, 37 lie opposite one another. Furthermore, the top webs 25, 35 lie on the outwardly pointing sides of the single flute corrugated cardboard webs 28, 38. The first and the second single flute corrugated cardboard web 28, 38 are transported further to a combining means 80. Here, the arrangement of the first and second single flute corrugated cardboard web 28, 38 with respect to one another realizes the construction principle of a double flute corrugated cardboard architecture comprising four layers.

Figure 2:
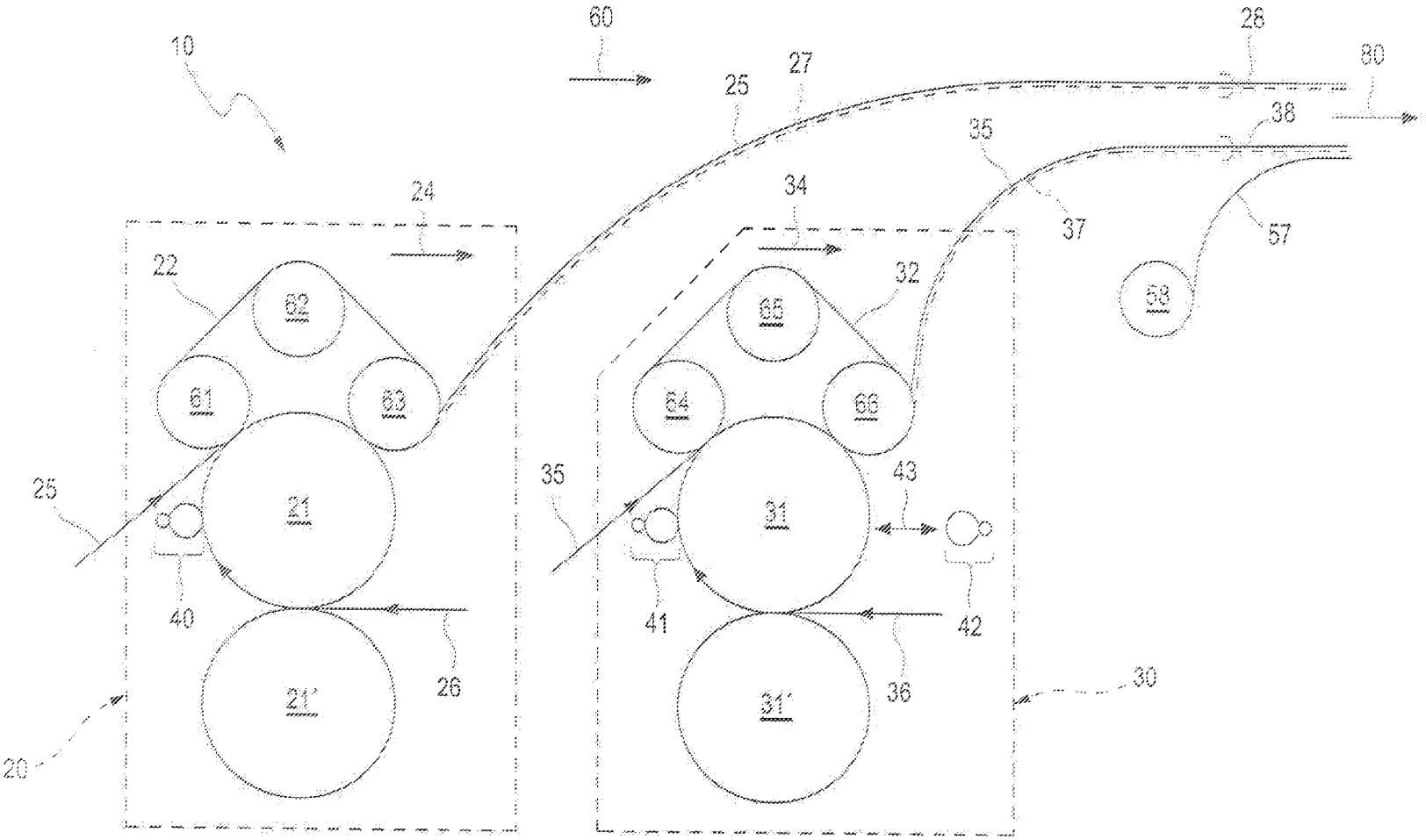
FIG. 2 shows a second arrangement of the first one-sided machine and the second one-sided machine, the two single flute corrugated cardboard webs running in the same direction.

FIG. 2 diagrammatically shows a second configuration of the apparatus 10 according to the invention. The configuration which is shown in FIG. 2 can be achieved by way of changeover of the configuration from FIG. 1. The apparatus 10 comprises a first and a second one-sided machine 20, 30 which are arranged one behind another in the running direction 60 of the apparatus. Here, the first and the second one-sided machine in each case have a first and second conveying direction 24, 34 which are oriented in the same direction. The first and second one-sided machine 20, 30 in each case comprise a first and second corrugating roll 21, 31 and their respective counterparts 21', 31'. The first corrugating roll 21 and the first counterpart 21' form a nip on their circumferential faces, into which nip a first paper web 26 is drawn in. Here, a corrugation profile is embossed onto the first paper web 26 by way of the first corrugating roll 21. Furthermore, the first one-sided machine 20 is equipped with a first glue application unit 40 which is arranged on a circumferential face of the first corrugating roll. The first glue application unit 40 provides an adhesive to the side of the first paper web 26 which faces away from the circumferential face of the first corrugating roll 21. The adhesive which is applied to the first paper web 26 by way of the first glue application unit 40 ensures an adhesive connection to the first top web 25. The first top web 25 and the first paper web 26 are pressed with one another and are adhesively bonded in a nip between the first corrugating roll 21 and a pressing belt 22. The pressing belt 22 is guided tautly by belt guiding rollers 61, 62, 63. The first paper web 26 forms a corrugated web 27 of a single flute corrugated cardboard web after the exit from the nip between the pressing belt 22 and the first corrugating roll 21.

In the same way, a second paper web 36 is drawn into a roll nip between the second corrugating roll 31 and its counterpart 31' and is provided with a corrugation profile. Furthermore, the second one-sided machine 30 is provided with a second and a third glue application unit 41, 42. The second glue application unit 41 is attached on the circumferential face of the second corrugating roll 31 and coats the second paper web 36 with adhesive on a side which faces away from the circumferential face of the second corrugating roll 31. The third glue application unit 42 of the second one-sided machine 30 is positioned such that it is offset laterally with respect to the circumferential face of the second corrugating roll 31 along a movement direction 43. Here, the third glue application unit 42 can be moved along a movement direction 43 and can be moved into contact with the circumferential face of the second corrugating roll 31 for a changeover of the second one-sided machine 30 which is associated with a reversal of the second web conveying direction 34.

A second top web 35 is drawn into a nip between the second pressing belt 32 which is guided tautly by belt guiding rollers 64, 65, 66 and the second corrugating roll 31. The second paper web which is provided with adhesive by way of the second glue application unit 41 is drawn together with the second top web 35 into a nip between the second pressing belt 32 and the second corrugating roll 31. As a result, the second top web 35 and the second paper web 36 are adhesively bonded to one another and pressed. When the second top web 35 and the second paper web 26 exit, they form a second single flute corrugated cardboard web 38. The second paper web which is provided with a corrugation profile by means of the second corrugating roll 31 forms a corrugated web 37 in the second single flute corrugated cardboard web 38.

The first and second single flute corrugated cardboard web 28, 38 are oriented with respect to one another in such a way that the corrugated web 27 of the first single flute corrugated cardboard web 28 faces the second top web 35 of the second single flute corrugated cardboard web 35. The first and second single flute corrugated cardboard web 28, 38 are transported further to a combining means 80 in a common running direction of the apparatus according to the invention. Furthermore, the apparatus according to the invention is provided with a feed roller 58 which provides an additional top web 57 during operation. The additional top web 57 is guided onto the second single flute corrugated cardboard web 37 in such a way that it faces the corrugated web 37 of the second single flute corrugated cardboard web 37. The arrangement of the first and second single flute corrugated cardboard web 28, 38 and the additional top web 57 corresponds to a conventional corrugated cardboard architecture comprising five layers.

Figure 3:
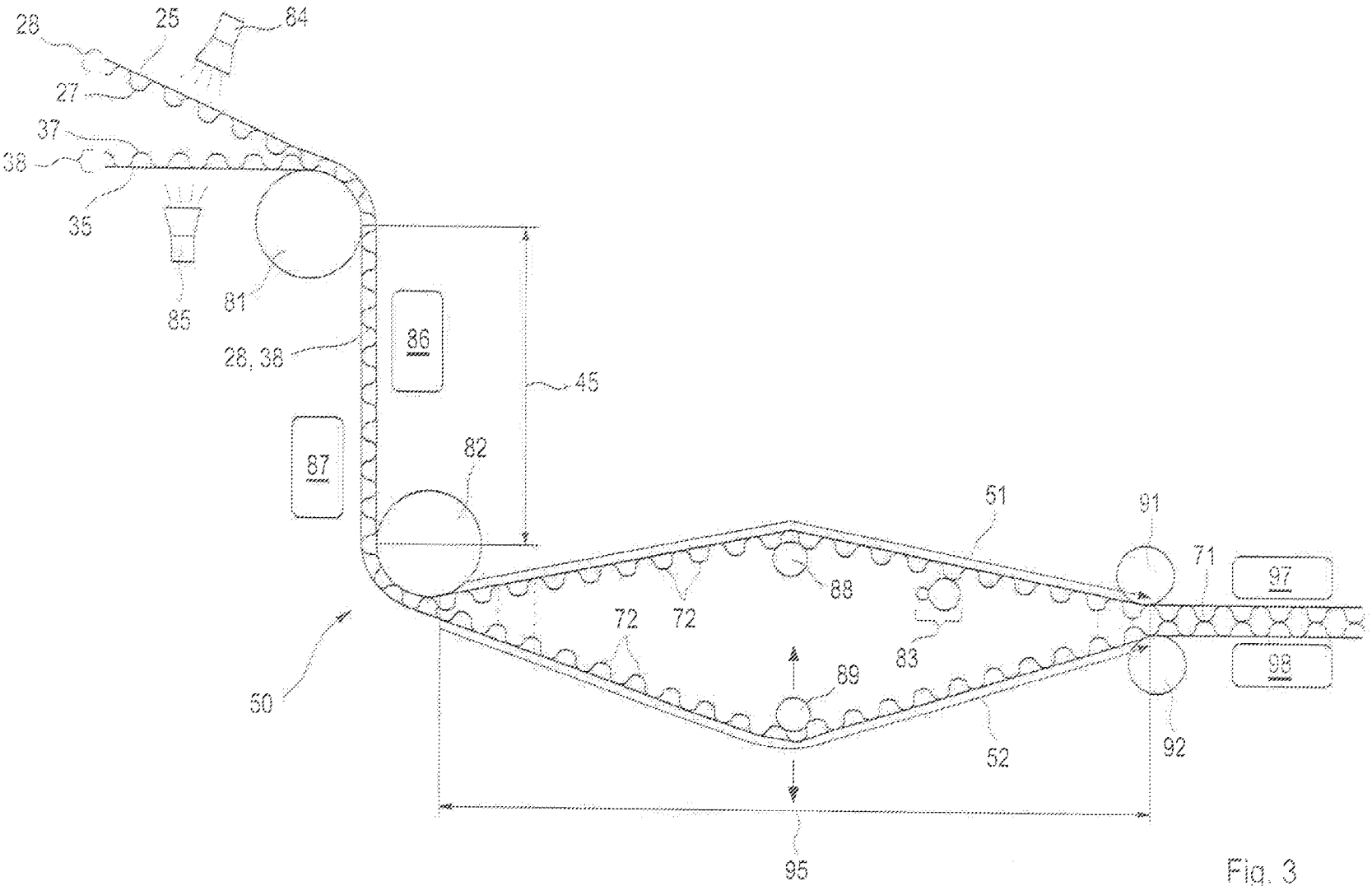
FIG. 3 shows a combining means of two single flute corrugated cardboard webs to produce a corrugated cardboard product.

FIG. 3 shows a combining means 80, in which the first single flute corrugated cardboard web 28 is adapted to the second single flute corrugated cardboard web 38 and they are connected to one another. In an entry region, the combining means 80 is equipped with a first and a second water vapor supply 84, 85. The first water vapor supply 84 is arranged in such a way that the first top web 25 of the first single flute corrugated cardboard web 28 is loaded with water vapor. Furthermore, the second water vapor supply 85 is arranged in such a way that the second top web 35 of the second single flute corrugated cardboard web 38 is loaded with water vapor. The loading with water vapor by way of the first and second water vapor supply 84, 85 leads to plastification of the first and second single flute corrugated cardboard web 28, 38. The first and second single flute corrugated cardboard web 28, 38 are subsequently guided jointly around a circumferential face of a diverting roller 81. The first and second single flute corrugated cardboard web come into contact with one another in such a way that head points 72 of the first corrugated web 27 are in engagement with foot points of the second corrugated web 37. The loading with water vapor by way of the water vapor supplies 84, 85 increases the deformability of the corrugated webs 27, 37 of the first and second single flute corrugated cardboard web 28, 38. The latter, in engagement with one another, run through a convergence region 45 which extends between the first diverting roller 81 and a second diverting roller 82. A heating body 86 is attached along the convergence region 45, which heating body 86 outputs heat to the first and second single flute corrugated cardboard web 28, 38 which are in engagement with one another. The heating of the two single flute corrugated cardboard webs 28, 38 reduces their deformability. The shape, which is adapted to one another, of the corrugated webs 27, 37 is fixed by way of the heating by means of the heating body 86.

Furthermore, the first and second single flute corrugated cardboard web 28, 38 run around the second diverting roller, and pass the outlet 50 of the diverting roller. At the outlet 50 of the diverting roller 82, the first and second single flute corrugated cardboard web 28, 38 are separated from one another. After the separation, the first and second single flute corrugated cardboard web separately run through a divergence region 95. The divergence region is of substantially diamond-shaped design, the first and second single flute corrugated cardboard web in each case passing a deflection roll 88, 90. The first single flute corrugated cardboard web 28 is diverted over the first deflection roll 88 which is mounted fixedly. The position of the first deflection roll 88 determines the length of a first running path 51 which extends from the outlet 50 of the diverting roller 82 as far as the end of the divergence region 95. The first running path 51 runs completely through the divergence region 95.

Furthermore, the divergence region 95 is equipped with a second heating body 87. The second heating body 87 allows the second single flute corrugated cardboard web to be dried further by way of further thermal irradiation. The second single flute corrugated cardboard web 38 is diverted over a second deflection roll 89 which can be moved in a direction transversely with respect to the extent of the divergence region. Here, the position of the second deflection roll 89 determines the length of a second running path 52. The second running path 52 runs completely through the divergence region 95. The position of the second deflection roll 89 is set in such a way that the second running path 52 differs from the first running path 51 by half a corrugation length of the second corrugated web 37. Immediately downstream of the outlet 50 of the second diverting roller 82, the head points 72 of the second single flute corrugated cardboard web 38 and the foot points of the first single flute corrugated cardboard web 28 lie opposite one another. At the end of the first and second running path 51, 52, the head points 72 of the first and second single flute corrugated cardboard web 28, 38 lie opposite one another. Downstream of the divergence region 95, the head points 72 which lie opposite one another mutually form contact points 71. The contact points 71 ensure a head-to-head position of the first and second single flute corrugated cardboard web with respect to one another. The first and second single flute corrugated cardboard web which are connected to one another in such a way form a corrugated cardboard product 90 which does not have a continuous middle paper web. Furthermore, at the end of the divergence region 95, the combining means 80 has additional processing apparatuses 97, 98 for further treatment of the corrugated cardboard product 90. The processing apparatuses 97, 98 can be configured as plates, heating plates, belts or rolls.

Figure 4:
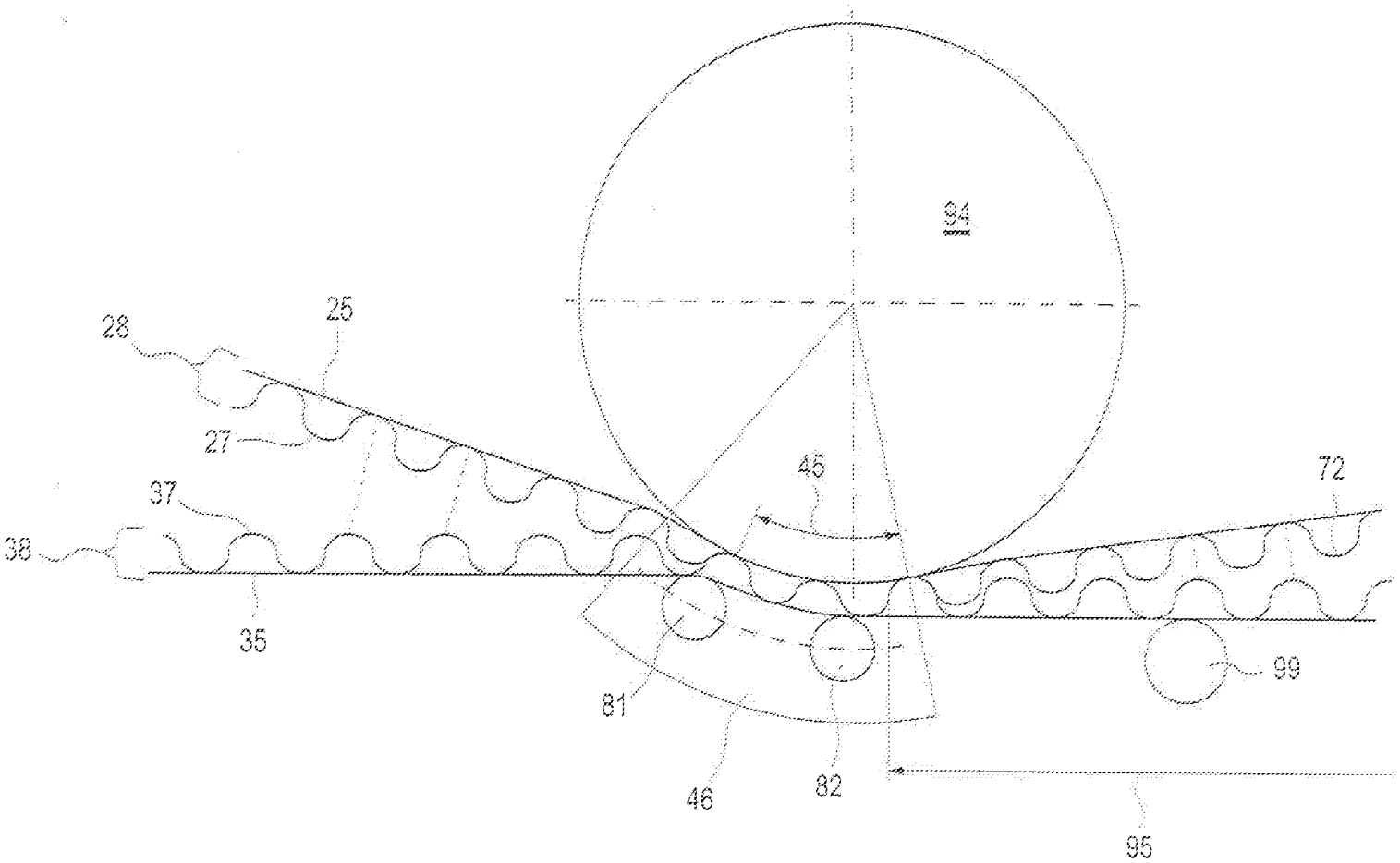
FIG. 4 shows an alternative embodiment of a combining means.

FIG. 4 shows an alternative embodiment of the apparatus according to the invention. According to FIG. 4, a first single flute corrugated cardboard web 28 and a second single flute corrugated cardboard web run toward a heating cylinder. The first and second single flute corrugated cardboard web 28, 38 are arranged in such a way that the head and foot points of the single flute corrugated cardboard webs 28, 38 in each case lie opposite one another. The single flute corrugated cardboard webs 28, 38 are pressed in the region of the heating cylinder 94 onto the circumferential face of the latter and come into contact with one another in such a way that the head points of the second single flute corrugated cardboard web 38 are in contact with the foot points of the first single flute corrugated cardboard web 28. The first and/or second single flute corrugated cardboard web 38 have/has previously been loaded with water vapor by means of water vapor supplies 84, 85.

In the region of the heating cylinder 94, the first and second single flute corrugated cardboard web 28, 38 are additionally guided by diverting rollers 81, 82. The first and second single flute corrugated cardboard web run through the nips which are formed between the heating cylinder 94 and the first and second diverting roller 81, 82. The first and second diverting roller 81, 82 are received on a roller support 46 which can be pivoted about the center point of the heating cylinder 94. Here, the position of the first diverting roller 81 defines the beginning of a convergence region 45, in which the first and second single flute corrugated cardboard web 28, 38 are in engagement with one another. The first and second single flute corrugated cardboard web 28, 38 are guided along a circumferential face of the heating cylinder 94 and are dried as a result. The drying reduces the deformability of the first and second single flute corrugated cardboard web 28, 38. The corrugation profiles which are adapted to one another of the corrugated webs 27, 37 of the single flute corrugated cardboard web 28, 38 are fixed by way of the heat supply of the heating cylinder 94. Here, the length of the convergence region 45 defines to what extent the first and second single flute corrugated cardboard web 28, 38 are dried.

Downstream of the heating cylinder 94, the contact of the head and foot points of the first and second single flute corrugated cardboard web 28, 38 is released. The mutual release of the head and foot points of the corrugated webs 27, 38 defines the beginning of a divergence region 95. The further course of the second single flute corrugated cardboard web 38 is guided in the divergence region 95 by means of a guide roll 99.

Figure 5:
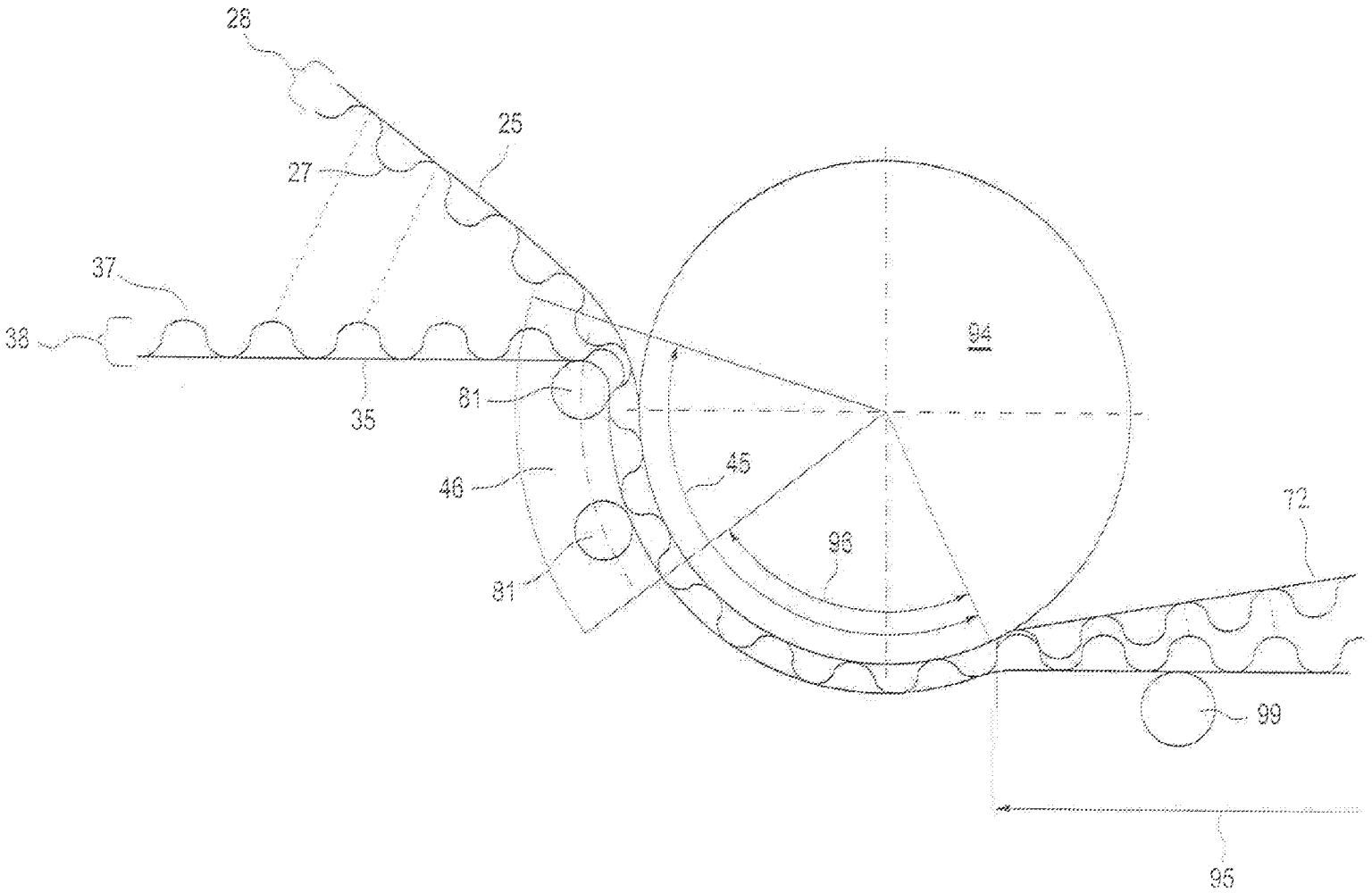
FIG. 5 shows an alternative embodiment of a combining means in a deflected state.

FIG. 5 shows a heating cylinder according to FIG. 4 in a deflected state. According to FIG. 5, the roller support 46 is deflected with the diverting rollers 81, 84 by a pivoting angle 96. The first and second single flute corrugated cardboard web 28, 38 come into contact with one another in the region of the first diverting roller 81. Here, the head and foot points of the first and second single flute corrugated cardboard web 28, 38 are in contact. After the convergence region 95 has been run through, the contacts between the head and foot points of the first and second single flute corrugated cardboard web 28, 38 are released. The convergence region 45 comprises an angular region which is defined by the position of the first diverting roller 81 and an edge of the roller support 46, and an arcuate section which is defined by the pivoting angle 96 at the circumference of the heating cylinder 95. The convergence region 45 can be extended in a freely selectable manner by way of a corresponding selection of the pivoting angle 96.

LIST OF DESIGNATIONS

10 Apparatus
20 First one-sided machine
21 First corrugating roll
21' Counterpart, first corrugating roll
22 First pressing belt
24 First web conveying direction
25 First top web
26 First paper web
27 Corrugated web
28 First single flute corrugated cardboard web
30 Second one-sided machine
31 Second corrugating roll
31' Counterpart, second corrugating roll
32 Second pressing belt
34 Second web conveying direction
35 Second top web
36 Second paper web
37 Corrugated web
38 Second single flute corrugated cardboard web
40 Glue application unit
41 Glue application unit
42 Glue application unit
43 Movement direction
45 Convergence region
46 Roller support
50 Outlet, deflection roller
51 First running path
52 Second running path
57 Additional top web
58 Feed roller
60 Running direction
61 Belt guiding roller
62 Belt guiding roller
63 Belt guiding roller
64 Belt guiding roller
71 Contact point
72 Head point
78 First conveying direction
79 Second conveying direction
80 Adhesive station
81 Diverting roller
82 Diverting roller
83 Glue application roll
84 First water vapor supply
85 Second water vapor supply
86 Heating body
87 Heating body
88 Deflection roll
89 Deflection roll
90 Corrugated cardboard product
91 Orienting roller
92 Orienting roller
94 Heating cylinder
95 Divergence region
96 Pivoting angle
97 Additional processing apparatus
98 Additional processing apparatus
99 Guide roll

The invention claimed is:

1. An apparatus for producing corrugated cardboard products, comprising a first one-sided machine and a second one-sided machine which are configured in each case for producing a single flute corrugated cardboard web, and a combining means which is configured for connecting the single flute corrugated cardboard webs, whereas the combining means has a convergence region which is configured for mutual adaptation of the single flute corrugated cardboard webs, characterized in that the combining means is configured with a divergence region for separating two single flute corrugated cardboard webs by means of at least one deflecting roll, the first single flute corrugated cardboard web being combined with the second single flute corrugated cardboard web in the convergence region, head points of the corrugation profile of the first single flute corrugated cardboard web coming into contact with foot points of the corrugated profile of the second single flute corrugated cardboard web, wherein the convergence region is configured upstream of the divergence region.

2. The apparatus as claimed in claim 1, characterized in that the first one-sided machine is provided with a first corrugating roll and an associated counterpart which have a corrugation which runs parallel to the rotational axis of the first corrugating roll.

3. The apparatus as claimed in claim 1, characterized in that the second one-sided machine is provided with a second corrugating roll and an associated counterpart which both have a corrugation which runs parallel to the rotational axis of the second corrugated roll.

4. The apparatus as claimed in claim 1, characterized in that the convergence region is configured between a first and a second diverting roller.

5. The apparatus as claimed in claim 1, characterized in that the combining means is equipped with at least one water vapor supply which is arranged for moistening a top web of a single flute corrugated cardboard web.

6. The apparatus as claimed in claim 1, characterized in that the combining means is provided with at least one heating plate which is arranged for heating at least one single flute corrugated cardboard web.

7. The apparatus as claimed in claim 1, characterized in that the combining means is provided with a convergence region which comprises a heating cylinder.

8. The apparatus as claimed in claim 7, characterized in that the heating cylinder is provided with a roller support, in which a first and a second diverting roller are received rotatably, it being possible for the roller support to be pivoted about the center point of the heating cylinder.

9. The apparatus as claimed in claim 8, characterized in that the first and second diverting rollers form, in each case with the circumferential face of the heating cylinder, a nip for guiding through the first and second single flute corrugated cardboard web.

10. The apparatus as claimed in claim 1 characterized in that the divergence region has at least one deflecting roll which can be moved perpendicularly with respect to a running path of a single flute corrugated cardboard web.

11. The apparatus as claimed in claim 1, characterized in that the length of the first running path of the first single flute corrugated cardboard web differs from the length of the second running path of the second single flute corrugated cardboard web by half a corrugation length of a corrugation profile of the first single flute corrugated cardboard web.

12. The apparatus as claimed in claim 1, characterized in that the first one-sided machine has a first web conveying direction and the second one-sided machine has a second web conveying direction, it being possible for the second web conveying direction to be reversed.

13. The apparatus as claimed in claim 1, characterized in that the first one-sided machine or the second one-sided machine has a turning device for turning one single flute corrugated cardboard web.

14. A method for producing corrugated cardboard products, comprising the following steps:

a) production of a first single flute corrugated cardboard web from a first top web and a paper web by means of a first one-sided machine, b) production of a second single flute corrugated cardboard web from a second top web and a paper web by means of a second one-sided machine, c) transportation of the first and second single flute corrugated cardboard web into a combining means, d) connection of the first and second single flute corrugated cardboard web to produce a corrugated cardboard product, in step d), corrugation profiles of the first and the second single flute corrugated cardboard web being adapted to one another in a convergence region in a combining means, characterized in that the first and second single flute corrugated cardboard web are conveyed at an outlet of a diverting roller into a divergence region, the first and the second single flute corrugated cardboard web being separated from one another by means of at least one deflection roll whereas the first single flute corrugated cardboard web is combined with the second single flute corrugated cardboard web in the convergence region, head points of the corrugation profile of the first single flute corrugated cardboard web coming into contact with foot points of the corrugation profile of the second single flute corrugated cardboard web, wherein the convergence region is configured upstream of the divergence region.

15. The method as claimed in claim 14, characterized in that, in step d), at least one of the single flute corrugated cardboard webs is moistened by means of at least one water vapor supply before entry into the convergence region.

16. The method as claimed in claim 14, characterized in that the first and second single flute corrugated cardboard web is dried by way of at least one heating plate in the convergence region.

17. The method as claimed in claim 14, characterized in that the first single flute corrugated cardboard web covers a first running path in the divergence region and the second single flute corrugated cardboard web covers a second running path.

18. The method as claimed in claim 17, characterized in that the length of at least one of the running paths of the single flute corrugated cardboard webs is set by means of a deflection roll which can be displaced perpendicularly with respect to the running path.

19. The method as claimed in claim 14, characterized in that the length of the first running path differs from the length of the second running path by half a corrugation length of the corrugation profile of the first or second single flute corrugated cardboard web.

20. The method as claimed in claim 14, characterized in that the first and second single flute corrugated cardboard web make contact with one another at head points in step d), in each case two head points which make contact forming a common contact point.

21. The method as claimed in claim 14, characterized in that the first and second single flute corrugated cardboard web are fed to one another by means of at least one orienting roller at the end of the divergence region.

22. The method as claimed in claim 14, characterized in that, in step d), the first and second single flute corrugated cardboard web are guided in the convergence region into nips between a heating cylinder and in each case a first and a second diverting roller, it being possible for the first and second diverting roller to be pivoted about the center point of the heating cylinder on a rotatable roller support.

23. The method as claimed in claim 22, characterized in that the length of the convergence region is increased by way of deflection of the roller support by a pivoting angle.

24. The method as claimed in claim 14, characterized in that at least one of the single flute corrugated cardboard webs is coated with adhesive by means of at least one glue application roll in the region of the combining means.

25. The method as claimed in claim 14, characterized in that one single flute corrugated cardboard web is turned by means of a turning device before step d).

* * * * *